US006665953B2

(12) United States Patent
Woo et al.

(10) Patent No.: US 6,665,953 B2
(45) Date of Patent: Dec. 23, 2003

(54) METHOD FOR CONTROLLING WASHING AND DRYING MACHINE

(75) Inventors: Kyung Chul Woo, Seoul (KR); In Chul Jeong, Kyonggi-do (KR); Kyeong Hwan Kim, Kyonggi-do (KR); Choon Myun Chung, Kyonggi-do (KR); Mu Yong Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/108,719

(22) Filed: Mar. 29, 2002

(65) Prior Publication Data

US 2003/0066206 A1 Apr. 10, 2003

(30) Foreign Application Priority Data

Oct. 4, 2001 (KR) ..... P2001-61251

(51) Int. Cl.[7] ..... F26B 5/08; F26B 11/02; D06F 29/00

(52) U.S. Cl. ..... 34/527; 34/318; 34/595; 34/604; 68/19; 68/20

(58) Field of Search ..... 34/595, 596, 604, 34/605, 606, 607, 527, 318; 68/19, 20, 23.5, 137, 207

(56) References Cited

U.S. PATENT DOCUMENTS 3,006,176 A * 10/1961 Behrens ..... 68/12
3,048,027 A * 8/1962 Mellinger ..... 68/12
3,078,702 A * 2/1963 Conlee ..... 68/20
5,207,764 A * 5/1993 Akabane et al. ..... 68/20
5,220,813 A * 6/1993 Chen et al. ..... 68/3 SS
5,718,130 A * 2/1998 Kim ..... 68/19.2
5,887,456 A * 3/1999 Tanigawa et al. ..... 68/20
6,116,060 A * 9/2000 Strader ..... 68/20
6,378,342 B1 * 4/2002 Fukumoto et al. ..... 68/20
6,481,248 B2 * 11/2002 Willis ..... 68/19.2

FOREIGN PATENT DOCUMENTS

KR 1229160 A1 * 8/2002 ..... D06F/17/06

* cited by examiner

*Primary Examiner*—Ira S. Lazarus
*Assistant Examiner*—Kenneth B Rinehart
(74) *Attorney, Agent, or Firm*—Birch, Stewart, Kolasch & Birch, LLP

(57) ABSTRACT

Method for controlling a washing and drying machine, for improving drying performance, and saving energy, the method having a drying cycle for supplying heated air into an inner tub to dry laundry in the inner tub, wherein the drying cycle includes a plurality of drying steps each having the steps of rotating a pulsator for a preset time period, and rotating the inner tub for a preset time period in regular and reverse directions, for enhancing flow of the laundry.

13 Claims, 5 Drawing Sheets

METHOD FOR CONTROLLING WASHING AND DRYING MACHINE

This application claims the benefit of the Korean Application No. P2001-61251 filed on Oct. 4, 2001, which is hereby incorporated by reference.

BACKGROUND OF THE INVENTION

1. Field of the Invention

The present invention relates to a washing and drying machine, and more particularly to a method for controlling a washing and drying machine, which can improve a drying performance, and save energy.

2. Background of the Related Art

Of the washing machine, removing contaminants from laundry by applying an energy, such as impact and the like, there are a pulsator type washing machine, a drum type washing machine, and an agitator type washing machine depending on a type of energy application to the laundry. That is, the washing is done by applying impacts to the laundry by means of a pulsator, or agitator, or by dropping the laundry by rotating a drum. Moreover, an action of detergent is added thereto, to make the washing done.

In general, the foregoing washing machines only have a washing function for washing laundry, such as clothes, so as to require taking out the laundry from the washing machine and drying under the sun.

Recently, owing to the wide spread apartment living, and change of living patterns, artificial fast drying of washed laundry is required, and to meet such a requirement, dryers are developed. The development of dryer facilitates convenient, and fast dry of the washed laundry.

However, since the dryer has a size similar to the washing machine, installation of the washing machine and the dryer separately requires much space, and inconvenient in that the laundry, once washed, is required to be taken out of the washing machine and put into the dryer, again.

According to this, development of a washing machine having a drying function has been required. Eventually, in a drum type washing machine, a washing machine having a drying function is suggested, in which the laundry is dried in the drum in situ without transferring the laundry after completion of washing. However, the pulsator type or the agitator type washing machine, which in general has a better washing performance, has had no drying function. Accordingly, development of a pulsator type washing machine with a good washing performance and a drying function has been required. Also, even in the pulsator type washing and drying machine, it is preferable that the pulsator type washing and drying machine has an improved drying performance, and can save an energy.

SUMMARY OF THE INVENTION

Accordingly, the present invention is directed to a method for controlling a washing and drying machine that substantially obviates one or more of the problems due to limitations and disadvantages of the related art.

An object of the present invention is to provide a method for controlling a washing and drying machine, which can improve a drying performance.

Another object of the present invention is to provide a method for controlling a washing and drying machine, which can save an energy.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the method for controlling a washing and drying machine includes a pre-heating type drying step for elevating a temperature of an inside of an inner tub to a preset temperature in a state the inner tub is substantially tightly closed, a mixed type drying step for repeating closing/opening of the inner tub while drying laundry in the inner tub, and an air discharging type drying step for drying the laundry in the inner tub in a state the inner tub is substantially opened.

Preferably, the method for controlling a washing and drying machine further includes a cold air type drying step after the air discharging type drying step, for supplying unheated air into the inner tub, and rotating the pulsator.

The pre-heating type drying step preferably includes the steps of rotating the pulsator at a relatively low speed, and rotating the inner tub at a speed low enough not to push the laundry onto an inside wall of the inner tub.

The mixed type drying step preferably includes the steps of (a) rotating the pulsator at a comparatively high speed, and (b) rotating the inner tub at a comparatively high speed, for disentangling the laundry.

The air discharging type drying step preferably includes the steps of (a) rotating the pulsator at a comparatively high speed, and (b) rotating the inner tub at a comparatively high speed, for disentangling the laundry.

The step (a) preferably includes the step of repeating regular and reverse direction rotations of the inner tub at rotation speeds and rotation angles different from each other, respectively.

The step (a) preferably includes the step of driving the pulsator for a time period that becomes shorter as the drying progresses, and the step (b) includes the step of rotating the inner tub at a speed that becomes higher as the drying progresses.

The step (a) preferably includes the step of driving the pulsator for a number of driving times that becomes greater as the drying progresses, and the step (b) includes the step of rotating the inner tub for a number of driving times that becomes greater as the drying progresses.

In another aspect of the present invention, there is provided a method for controlling a washing and drying machine, having a drying cycle for supplying heated air into an inner tub to dry laundry in the inner tub, wherein the drying cycle includes a plurality of drying steps each having the steps of rotating a pulsator for a preset time period, and rotating the inner tub for a preset time period in regular and reverse directions, for enhancing flow of the laundry.

The drying step preferably includes the steps of driving the pulsator for a time period that becomes shorter as the drying progresses, and rotating the inner tub at a speed that becomes higher as the drying progresses.

The drying step preferably includes the steps of driving the pulsator for a number of driving times that becomes greater as the drying progresses, and rotating the inner tub for a number of driving times that becomes greater as the drying progresses.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
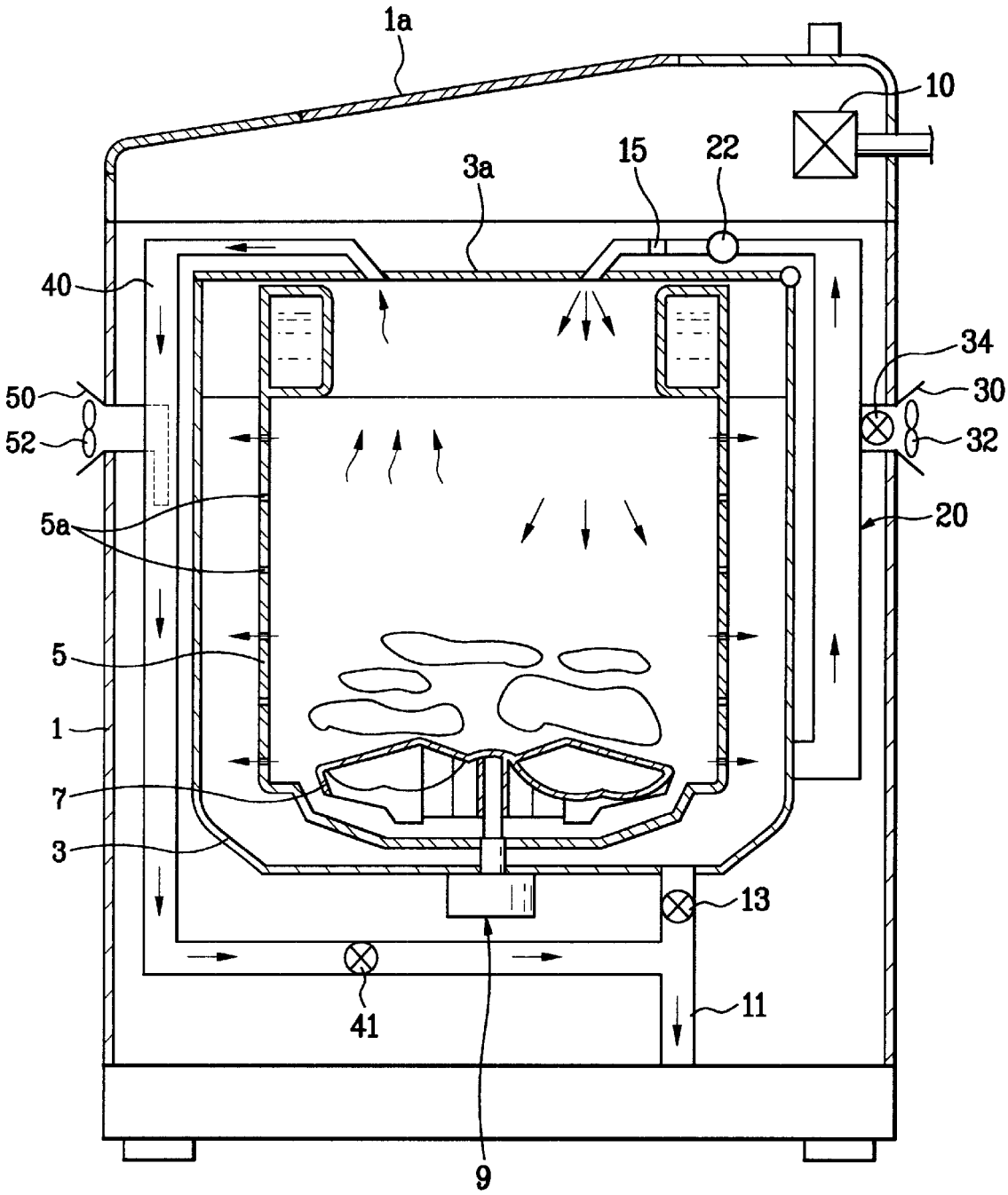
FIG. 1 illustrates a section of an exemplary washing and drying machine to which a method for controlling a washing and drying machine of the present invention is applicable.

Reference will now be made in detail to the preferred embodiments of the present invention, examples of which are illustrated in the accompanying drawings. Before starting a method for controlling a washing and drying machine of the present invention, an exemplary washing and drying machine the method of the present invention applicable thereto will be explained. The washing and drying machine will be explained, with reference to FIG. 1.

At first, components for washing laundry will be explained.

There are an outer tub 3 inside of a washing machine case 1 for storage of washing water, an inner tub 5 having a plurality of through holes 5*a* inside of the outer tub 3, and a pulsator 7 rotatably fitted inside of the inner tub 5. The inner tub 5 and the pulsator 7 are rotated by driving means 9 fitted to a bottom of the outer tub 3.

In the meantime, there is a water supply valve 10 in an upper part of the case 1 for supplying water for washing and rinsing, to which a water supply duct (not shown) for supplying water to the inner tub 5 is connected. There is a drain duct 11 connected to a bottom of the outer tub 3 for draining dirty water to an outside of the washing machine after completion of washing. There is a drain valve 13 fitted to the drain duct 11. An unexplained reference symbol 1*a* denotes a washing machine cover.

Next, components for drying the laundry will be explained.

There is a circulation duct 20 between an upper part and a lower part of the outer tub 3 for supplying heated air into the inner tub 5 for drying laundry. Of course, there are a heater 15 for heating air and a blower 22 for forced circulation of the air fitted to the circulation duct 20.

In the meantime, there is a closable inner cover 3*a* air tightly fitted to a top of the outer tub 3 for prevention of air leakage. It is preferable that a fore end of the circulation duct 20 is connected to the inner cover 3*a* or the top of the outer tub 3, and a lower end of the circulation duct 20 is connected to a side surface of the outer tub 3. Of course, the lower end of the circulation duct 20 may be connected to a bottom surface of the outer tub 3, when connection of duct (not shown) between the circulation duct 20 and the drain duct 11 is required for smooth flow of water condensed in the circulation duct 20 to the drain duct 11.

There are a first external air duct 30 connected to the circulation duct 20 for supplying external air, and a first external air fan 32 at an inlet of the first external air duct 30 for generating a suction force for drawing air, and a suction valve 34 fitted to the first external air duct 30 for cutting off air flow selectively.

Since the air discharged to the circulation duct 20 after drying the laundry in the inner tub 5 is hot and humid, it is preferable that the moisture contained in the air is removed because circulation of such a hot and humid air as it is drops a drying efficiency. Therefore, it is preferable that there is dehumidifying means fitted to the circulation duct 20. As the dehumidifying means, there may be an air cooling type dehumidifying means in which cooling fins are fitted to an outer surface of the circulation duct 20 for removal of the moisture, or water cooling type dehumidifying means in which cooling water is supplied to the circulation duct 20 for removal of the moisture. Or alternatively, the external air from the first external air fan 32 is supplied to the circulation duct 20, for heat exchange between the external air at a relatively low temperature and the hot and humid circulation air, for removal of the moisture.

For smooth dry, it is preferable that a portion of vapor humid excessively formed at a top part of the inner tub 5 is discharged. Accordingly, to do this, there is a discharge duct 40 fitted to the top part of the outer tub 3. That is, one end of the discharge duct 40 is connected to the inner cover 3*a* or a top surface of the outer tub 3, and the other end of the discharge duct 40 is preferably connected to the drain duct 11, though the other end may be opened to the air directly. In this instance, the drain duct 40 also serves as a drain for discharging overflowing washing water during washing.

Moreover, since it is not desirable that the excessively humid air is discharged to the air as it is through the discharge duct 40, a temperature and a humidity of the excessively humid air are dropped to some extents before the excessively humid air is discharged to the air. Accordingly, there is a second external air duct 50 connected to the discharge duct 40 for drawing in external air, with a second external air fan 52 fitted to an inlet to the second external air duct 50.

Also, in view of a structure, though only a portion of the air flows from the inner tub to the discharge duct 40 if the first external air fan 32 is not operative, a supplementary valve 41 may be fitted to the discharge duct 40 for perfect open/close of the discharge duct 40 if necessary.

The operation of the foregoing washing and drying machine will be explained, briefly. At first, a washing cycle will be explained.

The washing cycle is identical to the related art washing machine. That is, washing, rinsing, and spinning are carried out in succession, for washing the laundry. Upon completion of the washing and spinning, a drying cycle is started.

In the drying cycle, the heater 15 and the blower 22 are put into operation, to heat air and supply to the inner tub 5. The heated air 5 introduced into the inner tub 5 makes heat exchange with the laundry, to dry the laundry.

The drying cycle will be explained in detail with reference to FIG. 1.

The drying cycle is a step in which the heater 15 and the blower 22 are put into operation, to supply heated air to the inner tub 5 for drying the laundry. There may be a variety of drying cycles, which will be explained.

A method may be taken into consideration, in which external air is drawn and heated in a state the inner tub 5 is opened, a heat exchange is made between the heated air and the laundry in the inner tub 5, to dry the laundry, and heat exchanged air is discharged to the air (hereafter called as, "air discharging type drying method").

That is, in the air discharging type drying method, the suction valve 34 and the drain valve 13 are opened, to open the first external air duct 30 and the drain duct 11 respectively, the heated air is supplied to the inner tub 5 while the first external air fan 32 fitted to the first external air duct 30 is driven, and the air heat exchanged with the laundry is discharged to the air through the drain valve 13 as it is. This method has a possibility of causing an environmental problem as the hot and humid air is discharged to the air as it is.

Next, a method may be taken into consideration, in which air is heated in a state the inner tub 5 is closed, a heat exchange is made between the heated air and the laundry in the inner tub 5, to dry the laundry, and heat exchanged air is circulated to the inner tub 5 again (hereafter called as, "air circulating type drying method").

That is, in the air circulating type drying method, the first external air duct 30 and the drain duct 11 are closed, to circulate the air. Since it is preferable that water vapor is removed appropriately during circulation of the air, appropriate cooling of the first external air duct 30 by air or water is preferable. Though this method can reduce the environmental problem to some extent, the drying speed is slow.

Next, a method may be taken into consideration, in which closing/opening of the inner tub 5 are repeated. That is, though the air is circulated, an excessively humid vapor discharging step for discharging excessively humid vapor to the air intermittently during drying, and a condensed water discharging step for discharging condensed water, are added (hereafter called as "a mixed type drying method").

In detail, the first external air duct 30 and the drain duct 11 are closed, to circulate the air in the inner tub 5 to the inner tub 5 again for drying the laundry, and on the same time, vapor contained in the circulating air is removed.

In a course of a circulating type drying, the excessively humid vapor discharging step is carried out, in which the first external air duct 30 and/or the drain duct 11 are opened or closed, intermittently, or more preferably, at fixed time intervals, for discharging a portion of the excessively humid air in the inner tub 5 to the air through the discharge duct 40. It is preferable that the second external air fan 52 is put into operation during the excessively humid air discharging step, for dropping a temperature and a humidity of the excessively humid air by introducing the external air into the discharging duct 40 to make heat exchange between the external air and the excessively humid air.

The vapor contained in the air introduced into the circulation duct 20 is removed by appropriate dehumidifying means, to produce condensed water. Therefore, the condensed water discharging step is carried out, in which the drain duct 11 is opened intermittently, for discharging the condensed water produced in the drying step.

Though the drying cycle of the washing and drying machine may be carried out by using only one of the air discharging type drying method, the air circulating type drying method, and the mixed type drying method, it is preferable that the above drying methods are combined appropriately.

A method for controlling a drying cycle in accordance with a preferred embodiment of the present invention will be explained, with reference to FIG. 2.

Figure 2:
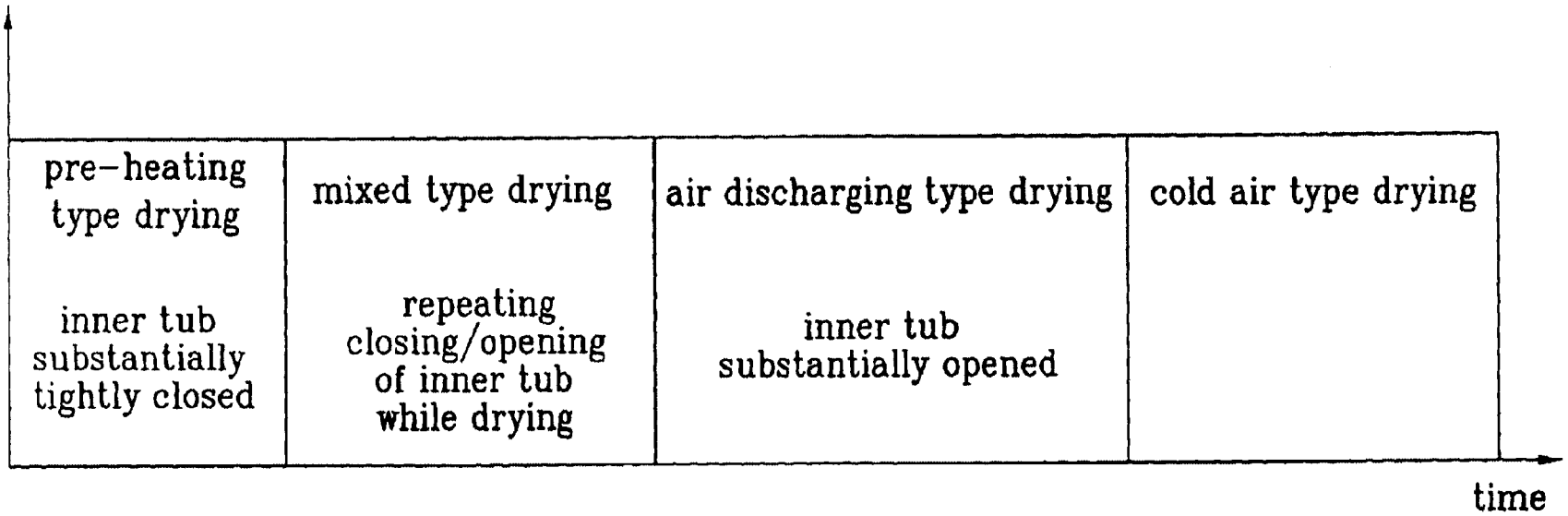
FIG. 2 illustrates a graph showing the steps of a drying cycle of a washing and drying machine of the present invention.

Referring to FIG. 2, the drying cycle includes a pre-heating step and a drying step the laundry is dried, substantially. It is preferable that the drying step is a combination of the mixed type drying method and the air discharging type drying method. Finally, it is more preferable that a cold air drying method is added thereto, in which the air is supplied to the laundry without heating the air.

In the pre-heating type drying step, the inner tub 5 and the laundry in the inner tub 5 are heated with the inner tub 5 closed substantially, for elevating temperatures of the inner tub 5 and the laundry in the inner tub 5 within a short time period. The pre-heating step is provided because high temperatures of the laundry and the inner tub 5 at starting of the drying step provide an environment favorable for evaporation of the vapor, as the evaporation and an internal saturated water vapor quantity are great.

It is preferable that the pulsator and the inner tub are rotated appropriately during respective drying steps, i.e., the pre-heating type drying, the mixed type drying, the air discharging type drying, because the rotation of the pulsator and the inner tub increases a heat exchange efficiency, and strengthens movement of the laundry resulting to mix the laundry smoothly, and improve a laundry drying performance.

Figure 3:
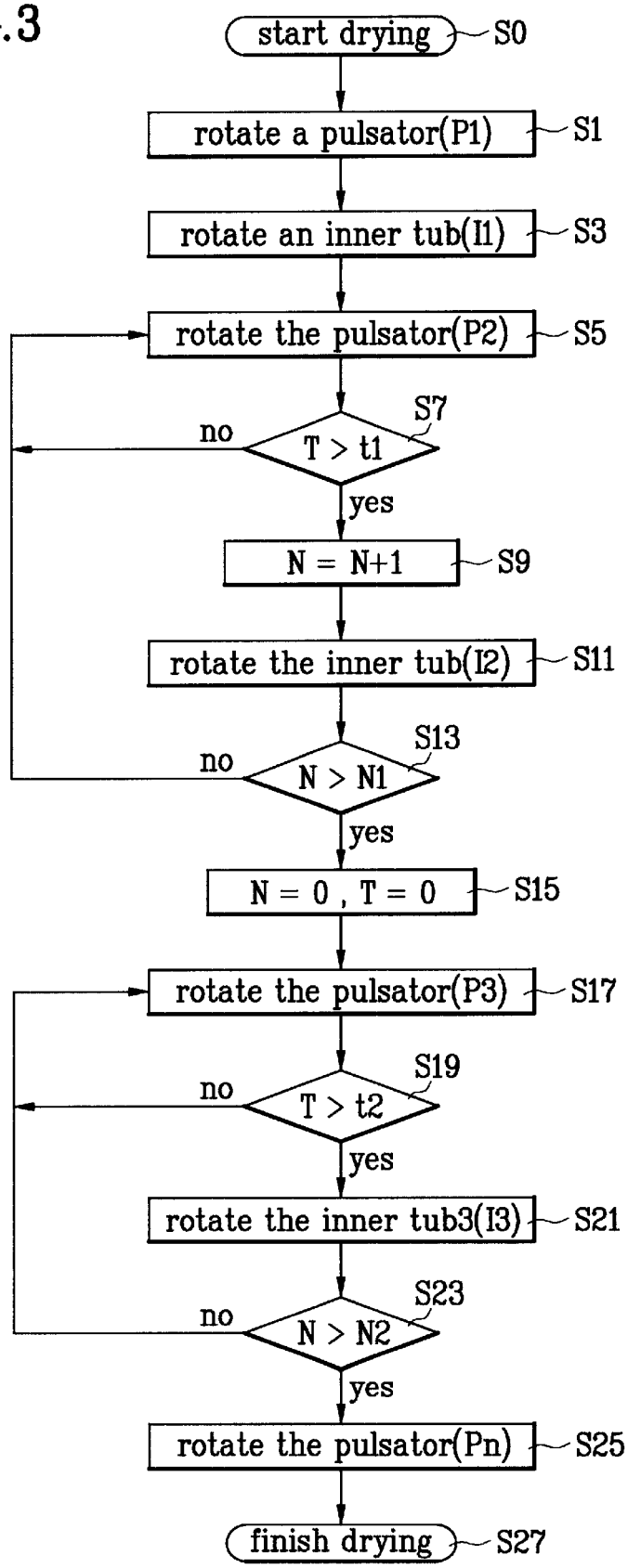
FIG. 3 illustrates a flow chart showing the steps of a method for controlling a washing and drying machine in accordance with a preferred embodiment of the present invention.
Figure 4:
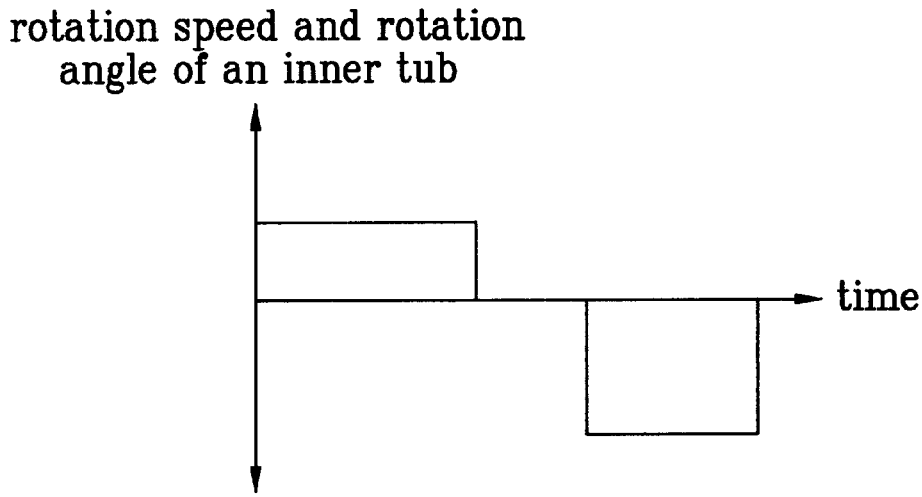
FIG. 4 illustrates a graph showing direction and speed of rotation of an inner tub in a drying cycle.

A method for controlling operation of the pulsator and the inner tub in the drying cycle will be explained, with reference to FIGS. 2 and 3.

In the pre-heating type drying after the drying is started, it is preferable that the laundry is pulsated, for a short while in a state the inner tub is closed, until an inside of the inner tub reaches to a preset temperature. That is, the pulsator is rotated in regular/reverse directions for short time period (a pulsator rotating pattern 1: P1) (S1), and then the inner tub is rotated at a low rotation speed (rpm) in left and right directions for a preset time period (an inner tub rotation pattern 1: I1) (S3).

In this instance, the pulsator rotates at comparatively low rpm and rotation amount (rotation angle), and the inner tub also rotates in left and right directions at a speed low enough not to push the laundry onto a wall surface of the inner tub.

When the inner tub reaches to a desired temperature, the next drying step, i.e., the mixed type drying is conducted. In the mixed type drying, closing/opening of the inner tub are repeated, while the pulsator and the inner tub are rotated at preset rpm.

In detail, the pulsator is rotated for a preset time period t1 (a pulsator rotation pattern 2: P2) (S5, and S7), and the inner tub is rotated at a time when there is a possible entangling of the laundry (an inner tub rotation pattern 2: I2) (S11). The rotation of the pulsator and the inner tub is repeated for a preset number of times N1 (S13). A main reason of the rotation of the pulsator and the inner tub is to make a laundry flow smooth for improving a drying performance. Thus, the number of driving times of the pulsator and the inner tub is a concept similar to a number of times of laundry mix.

It is preferable that the rotation speed rpm and rotation angle of the pulsator in this step are different from the rotation speed rpm and rotation angle of the pulsator in the preheating step, and it is more preferable that the rotation speed rpm and rotation angle of the pulsator in this step are greater the rotation speed rpm and rotation angle of the pulsator in the pre-heating step. It is also preferable that the inner tub is rotated in left and right directions at a high speed so that slightly entangled laundry is disentangled.

Then, the air discharging type drying is carried out, in which the pulsator and the inner tub are rotated in a state the inner tub is substantially opened. That is, the pulsator is rotated for a preset time period t2 (pulsator rotation pattern 3: P3) (S17, and S19), and the drying is conducted (S21), while the inner tub is rotated (an inner tub rotation pattern 3: I3). The foregoing rotation of the pulsator and the inner tub are repeated for a preset number of times N2 (S23).

Next, it is preferable that the cold air drying is carried out, in which only the pulsator is rotated (a pulsator rotation pattern 'n': Pn) for drying, with no heated air supplied to the inner tub (S25).

In the meantime, the pulsator and the inner tub are rotated in the foregoing different steps of drying, wherein it is preferable that driving patterns of the pulsator and the inner tub, i.e., rotation speed, rotation angle, and pause time period are varied appropriately in carrying out drying, because, since a weight of the laundry is varied with the moisture removal from the laundry as the drying is progressed, flow of the laundry may not be smooth if a driving pattern used in a prior step is used in the next step.

Figure 5:
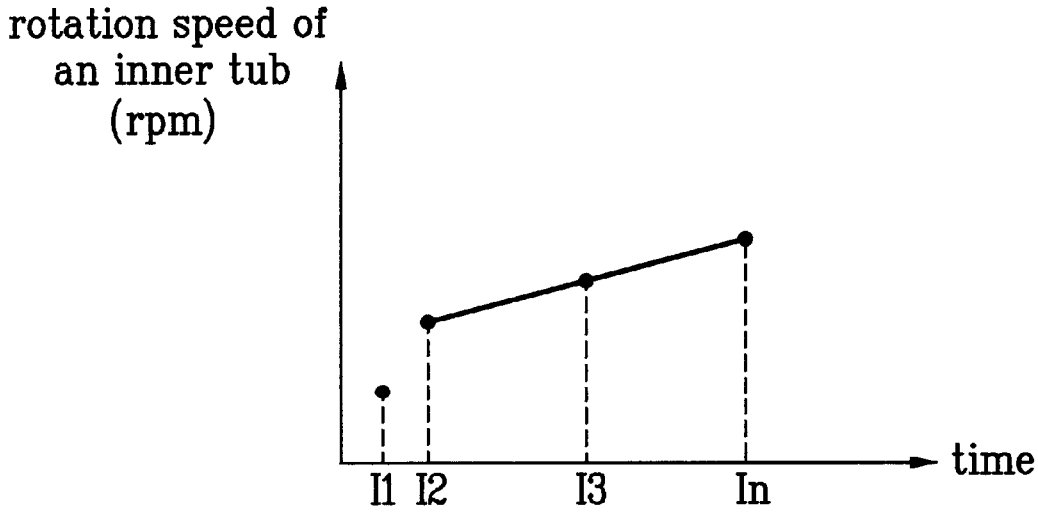
FIG. 5 illustrates a graph showing rotation speed of an inner tub vs. time as a drying cycle progresses.

In detail, referring to FIG. 5, it is preferable that a rotation speed of the inner tub is increased as the drying is progressed, for prevention of the laundry flow from becoming poor in a later part of the drying. Moreover, it is preferable that the inner tub is rotated in both directions, with varied rotation speed and angle.

Figure 6:
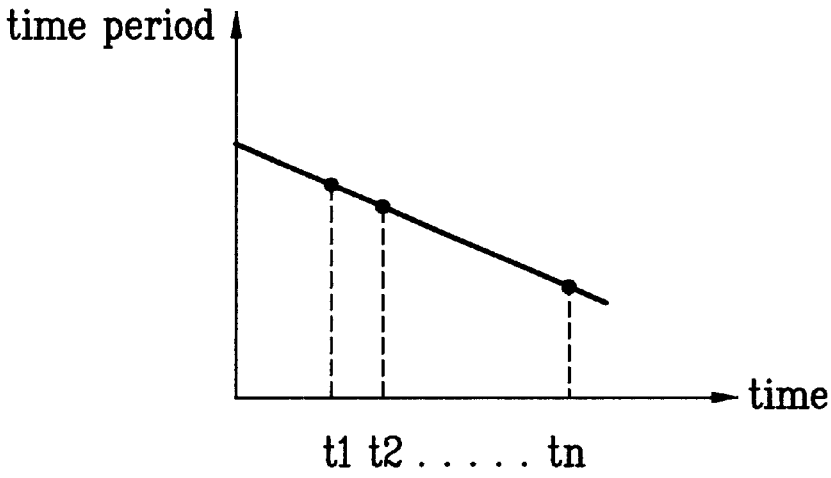
FIG. 6 illustrates a graph showing rotation time period of a pulsator vs. time as a drying cycle progresses; and, FIG. 7 illustrates a graph showing a number of laundry mix vs. time as a drying cycle progresses.

Also, referring to FIG. 6, it is preferable that a driving time period of the pulsator is set shorter as the drying progresses, and the pulsator is rotated in both directions, alternately.

Figure 7:
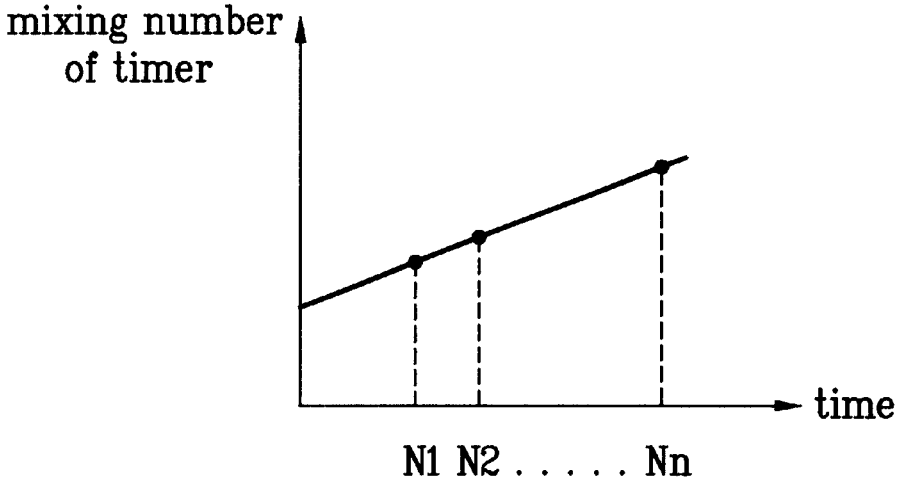

Moreover, referring to FIG. 7, it is preferable that the numbers of driving times of the pulsator and the inner tub are set greater as the drying progresses. That is, preferably, a period of mixing the laundry is made shorter while the repeating number of times within the same time period are increased, to drive in a greater variety of driving patterns, and to make flow of the laundry smooth, for enhancing the drying performance.

FIGS. 4 to 7 illustrate driving principles of the pulsator and the inner tub in the present invention, and actual rotation speed, rotation angle, number of driving times and the like may be adjusted appropriately according to conditions of an amount of the laundry, and the like.

Though a method for controlling driving of the pulsator and the inner tub is illustrated and explained in the foregoing embodiment when the drying cycle includes a pre-heating type drying, a mixed type drying, an air discharging type drying, and a cold air drying, the present invention is not limited to this. That is, it is of course possible that the principle of driving the pulsator and the inner tub of the present invention is applicable to a drying cycle in which any one of the drying methods, or a drying method the different drying methods are combined in a fashion different from the foregoing fashion, is used.

The advantages of the method for controlling a washing and drying machine of the present invention will be explained.

First, the low speed rotation of the inner tub in the step the laundry and the inner tub are heated in an initial stage of drying permits to elevate the temperature faster, and to save the power.

Second, rotation patterns of the pulsator and the inner tub are adjusted appropriately, as the drying is progressed. That is, the rotation speed is set the faster as the drying step progresses. According to this, the poor drying performance can be prevented, which is caused by poor disentangling of the laundry coming from reduced laundry weight as the drying progresses.

What is claimed is:

1. A method for controlling a washing and drying machine, comprising:

a pre-heating type drying step for elevating a temperature of an inside of an inner tub to a preset temperature in a state the inner tub is substantially tightly closed;

a mixed type drying step for repeating closing/opening of the inner tub while drying laundry in the inner tub; and, an air discharging type drying step for drying the laundry in the inner tub in a state the inner tub is substantially opened.

2. A method as claimed in claim 1, further comprising a cold air type drying step after the air discharging type drying step, for supplying unheated air into the inner tub, and rotating a pulsator.

3. A method as claimed in claim 1, wherein the pre-heating type drying step includes the steps of;

rotating a pulsator at a relatively low speed, and rotating the inner tub at a speed low enough not to push the laundry onto an inside wall of the inner tub.

4. A method as claimed in claim 1, wherein the mixed type drying step includes the steps of;

(a) rotating a pulsator at a comparatively high speed, and (b) rotating the inner tub at a comparatively high speed, for disentangling the laundry.

5. A method as claimed in claim 4, wherein the step (b) includes the step of repeating regular and reverse direction rotations of the inner tub.

6. A method as claimed in claim 5, wherein the regular and reverse direction rotations of the inner tub have different rotation speeds and rotation angles from each other, respectively.

7. A method as claimed in claim 1, wherein the air discharging type drying step includes the steps of;

(a) rotating a pulsator at a comparatively high speed, and (b) rotating the inner tub at a comparatively high speed, for disentangling the laundry.

8. A method as claimed in claim 7, wherein the step (b) includes the step of repeating regular and reverse direction rotations of the inner tub.

9. A method as claimed in claim 8, wherein the regular and reverse direction rotations of the inner tub have different rotation speeds and rotation angles from each other, respectively.

10. A method as claimed in claim 7, wherein the step (a) includes the step of driving the pulsator for a time period that becomes shorter as the drying progresses, and the step (b) includes the step of rotating the inner tub at a speed that becomes higher as the drying progresses.

11. A method as claimed in claim 7, wherein the step (a) includes the step of driving the pulsator for a number of driving times that becomes greater as the drying progresses, and the step (b) includes the step of rotating the inner tub for a number of driving times that becomes greater as the drying progresses.

12. A method for controlling a washing and drying machine, having a drying cycle for supplying heated air into an inner tub to dry laundry in the inner tub, wherein the drying cycle comprises a plurality of drying steps each including the steps of rotating a pulsator for a preset time period, and rotating the inner tub for a preset time period in regular and reverse directions, for enhancing flow of the laundry, wherein the drying step includes the steps of driving the pulsator for a time period that becomes shorter as the drying progresses, and rotating the inner tub at a speed that becomes higher as the drying progresses.

13. A method for controlling a washing and drying machine, having a drying cycle for supplying heated air into an inner tub to dry laundry in the inner tub, wherein the drying cycle comprises a plurality of drying steps each including the steps of rotating a pulsator for a preset time period, and rotating the inner tub for a preset time period in regular and reverse directions, for enhancing flow of the laundry, wherein the drying step includes the steps of driving the pulsator for a number of driving times that becomes greater as the drying progresses, and rotating the inner tub for a number of driving times that becomes greater as the drying progresses.

* * * * *